United States Patent [19]

Igarashi

[11] Patent Number: 4,671,122

[45] Date of Patent: Jun. 9, 1987

[54] SYSTEM FOR INSPECTING ATTACHED STATE OF SLIDE FASTENER SEPARABLE END STOP, AND INSPECTION APPARATUS USED IN SAID SYSTEM

[75] Inventor: Osamu Igarashi, Toyama, Japan

[73] Assignee: Yoshida Kogyo K. K., Tokyo, Japan

[21] Appl. No.: 786,161

[22] Filed: Oct. 9, 1985

Related U.S. Application Data

[62] Division of Ser. No. 557,954, Dec. 5, 1983, abandoned.

[30] Foreign Application Priority Data

Dec. 7, 1982 [JP] Japan ..... 57-214214
Dec. 7, 1982 [JP] Japan ..... 57-214215

[51] Int. Cl.[4] ..... G01B 3/00; G01B 5/18

[52] U.S. Cl. ..... 73/865.8; 29/767; 73/865.9

[58] Field of Search ..... 73/432 R, 432 V, 432 G, 73/865.8, 865.9, 432.1; 29/767, 766, 408, 410

[56] References Cited

U.S. PATENT DOCUMENTS

| | | | |
|---|---|---|---|
| 2,969,587 | 1/1961 | Dixon | 73/432 G |
| 3,530,563 | 9/1970 | Maeda | 29/768 |
| 4,236,292 | 12/1980 | Orr et al. | 29/408 |
| 4,300,283 | 11/1981 | Ueda | 29/766 |
| 4,368,570 | 1/1983 | Morita | 29/767 |
| 4,392,291 | 7/1983 | Iai | 29/766 |
| 4,443,924 | 4/1984 | Osaki | 29/767 |
| 4,510,658 | 4/1985 | Takahashi | 29/767 |

FOREIGN PATENT DOCUMENTS

| | | | |
|---|---|---|---|
| 2903353 | 12/1979 | Fed. Rep. of Germany . | |
| 3145411 | 7/1982 | Fed. Rep. of Germany . | |
| 113262 | 9/1979 | Japan | 73/432 V |

*Primary Examiner*—S. Leon Bashore
*Assistant Examiner*—K. M. Hastings
*Attorney, Agent, or Firm*—Hill, Van Santen, Steadman & Simpson

[57] ABSTRACT

Disclosed is a system for inspecting the attached state of a separable end stop attached to a slide fastener. The system is used with an apparatus for manufacturing a slide fastener equipped with a separable end stop. Fastener stringers are transported by a transfer unit while a separable end stop is attached to the stringers and a completed slide fastener is discharged by a discharge unit. The discharge unit operates in a first state for engaging and feeding a slide fastener, and a second state for allowing a slide fastener to pass freely therethrough. The transfer unit passes a slide fastener through the discharge unit and transports the slide fastener to an inspection apparatus located downstream of the discharge unit. The inspection apparatus grasps a separable end stop on a slide fastener delivered by being passed through the discharge unit by the transfer unit, whereby the transfer unit releases the slide fastener and is restored to a predetermined position for the manufacture of the next slide fastener.

3 Claims, 6 Drawing Figures

SYSTEM FOR INSPECTING ATTACHED STATE OF SLIDE FASTENER SEPARABLE END STOP, AND INSPECTION APPARATUS USED IN SAID SYSTEM

This is a division, of application Ser. No. 557,954, filed Dec. 5, 1983, now abandoned.

This invention relates to a system for inspecting the attached state of a separable end stop attached to a slide fastener. The invention also relates to an inspection apparatus used in an inspection system of the type described.

The manufacture of slide fasteners equipped with a separable end stop is now an automated process capable of high productivity. The apparatus for the automatic manufacture of such slide fasteners includes a transfer unit for transferring a pair of fastener stringers through the apparatus while a pin, box pin and box are attached to the fastener tapes, thereby to produce a completed slide fastener, and a discharge unit for discharging the slide fastener from the apparatus. Despite the automatic nature of the manufacturing process, however, it is required that an operator visually inspect the attached separable end stops to determine if they have been attached correctly. One reason for the visual inspection is the nonavailability of an apparatus that is capable of performing the inspection automatically without having an adverse effect upon the production efficiency of the apparatus for the automatic manufacture of the slide fastener having the separable end stop.

In the visual inspection, the inspector must visually confirm (a) that the pin, box pin and box have been attached to the fastener tapes, (b) that there is almost no gap between the pins and, hence, that the pins are parallel and closely adjacent to each other, and (c) that there is sufficient depth to the notches that are formed when the pins and box are attached to the fastener tapes by caulking, i.e., that the caulking operation has been performed in good order. Owing to such reliance upon human labor, an inspection of this kind is inefficient and does not make it possible to measure, with any accuracy, the depth of the notches formed by caulking. Accordingly, there is demand for an apparatus that is capable of performing the foregoing inspections automatically and in a short period of time.

An object of the present invention is to provide an inspection system capable of inspecting the attached state of a separable end stop automatically with almost no effect upon the operation of an apparatus for automatically manufacturing a slide fastener equipped with such an end stop.

Another object of the present invention is to provide an apparatus for use in the above-described inspection system, which apparatus is capable of inspecting the attached state of a separable end stop in a short period of time.

According to the present invention, the foregoing objects are attained by providing a system for inspecting the state in which a separable end stop is attached to a slide fastener. The system is used in an apparatus for manufacturing a slide fastener equipped with a separable end stop, in which fastener stringers are transported by a transfer unit while a separable end stop is attached to the stringers and a completed slide fastener is discharged by a discharge unit. The discharge unit is adapted to operate in a first state for engaging and feeding a slide fastener, and a second state for allowing a slide fastener to pass freely therethrough. The transfer unit is adapted to pass a slide fastener through the discharge unit and transport the slide fastener to a point downstream of the discharge unit. Provided downstream of the discharge unit is an inspection apparatus for grasping a separable end stop on a slide fastener delivered by being passed through the discharge unit by the transfer unit, whereby the transfer unit is able to release the slide fastener and to be restored to a predetermined position for the manufacture of the next slide fastener.

The inspection apparatus comprises upper and lower molds capable of being opened and closed, and further includes a retaining portion, provided on each mold, for grasping a box of a slide fastener, equipped with a separable end stop, when the molds are closed, and an inspecting member provided on one of the molds so as to be displaceable relative thereto. The inspecting member has inspecting projections which fit into caulking notches formed in a pin, box pin and box of the slide fastener, and is biased in a direction for fitting the inspecting projections into the notches, the depth of the notches being sensed based on displacement of the inspecting member when the upper and lower molds are closed.

Other objects and advantages of the invention will become clear from the following description of an embodiment of the invention referring to the drawings, in which.

Figure 1:
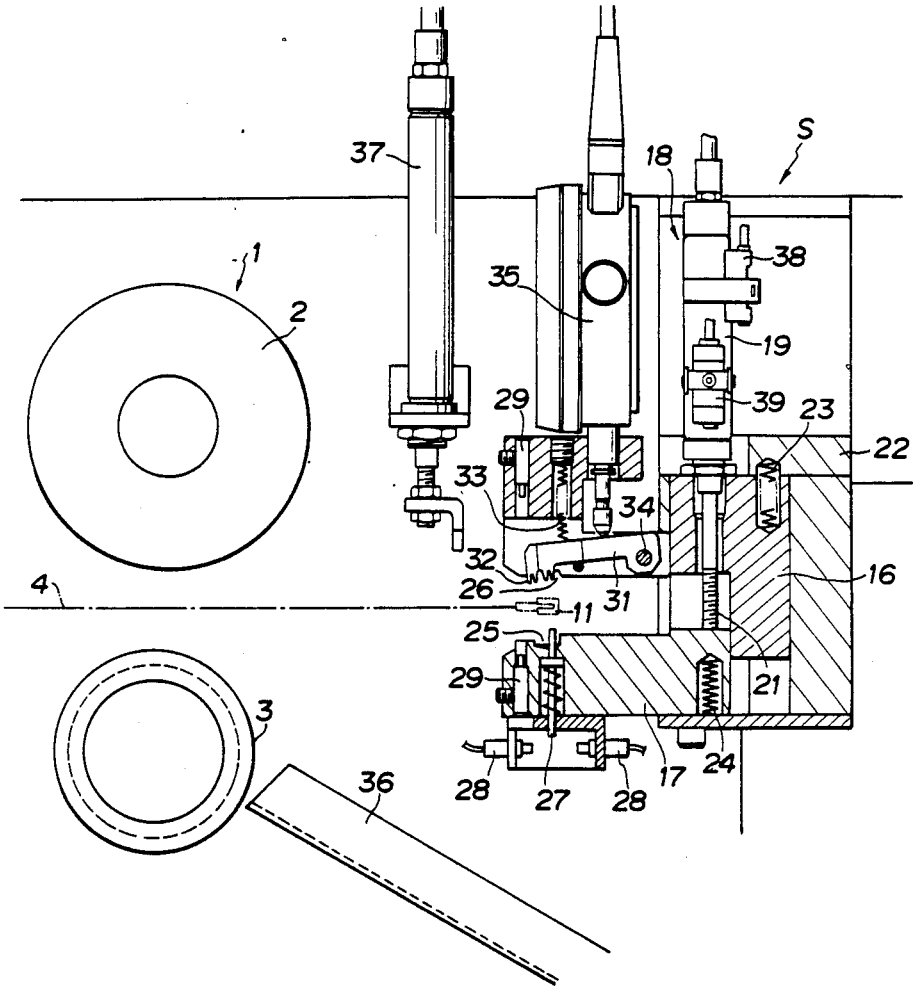
FIG. 1 is a vertical sectional view showing an embodiment of an inspection apparatus according to the present invention, as well as a discharge unit of an apparatus for manufacturing a slide fastener equipped with a separable end stop.
Figure 2:
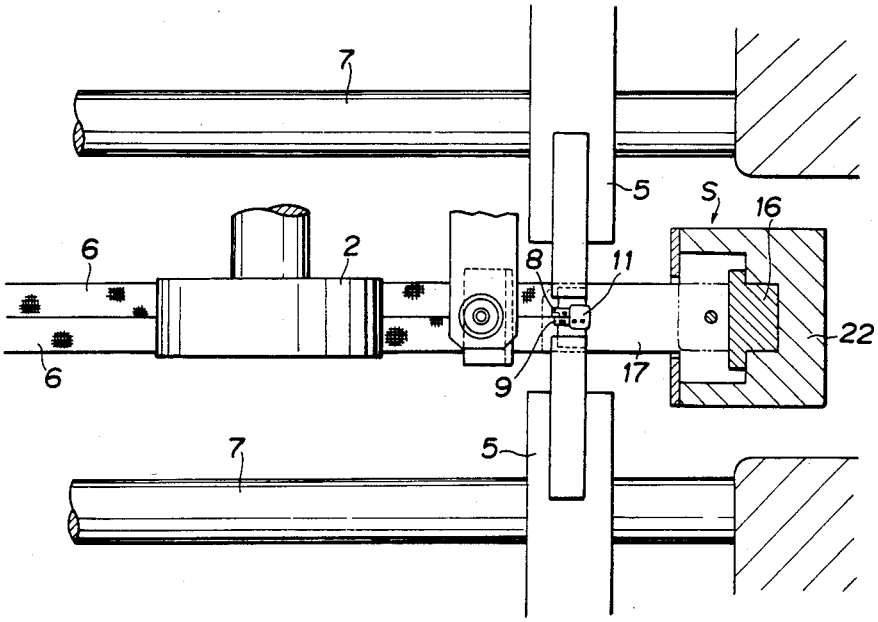
FIG. 2 is a horizontal sectional view illustrating the arrangement of FIG. 1.
Figure 3:
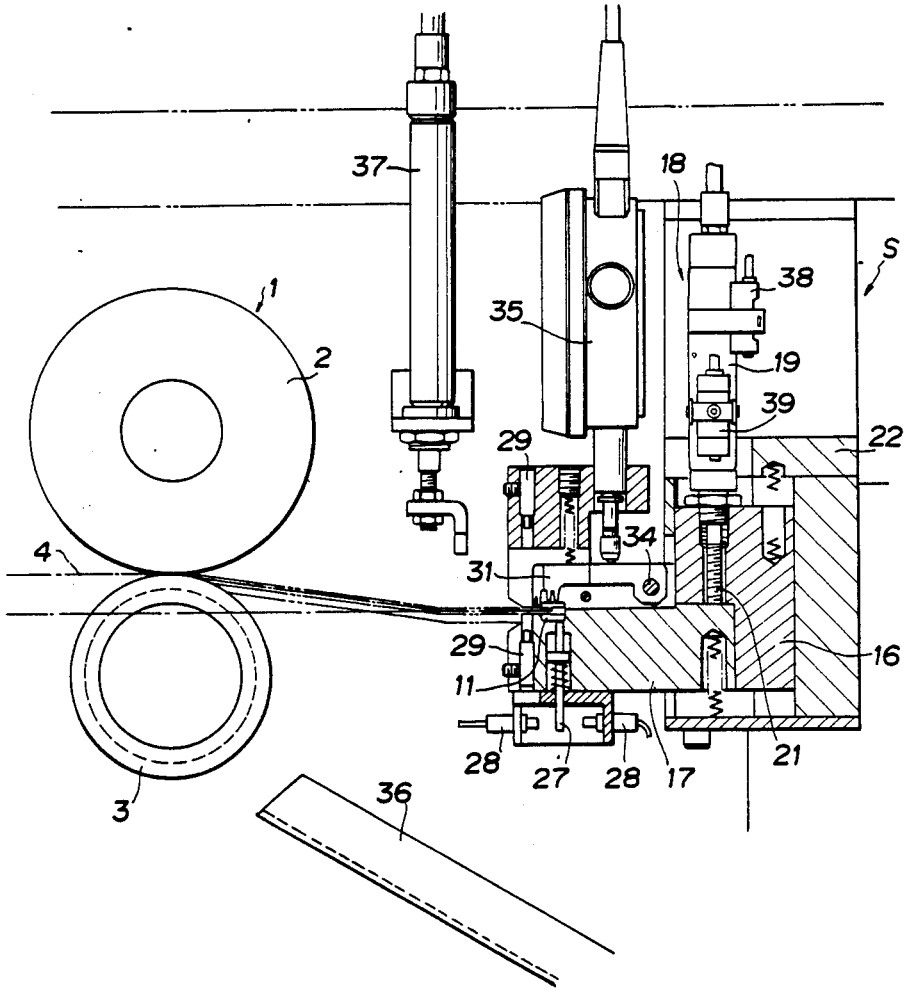
FIG. 3 is a view, which is similar to that of FIG. 1, showing a slide fastener clamped between a pair of rollers in the discharge unit as the inspection apparatus becomes operational, the illustrated condition showing the start of a feed operation for discharging the slide fastener.

FIG. 1 is a view showing an inspection apparatus S according to the present invention, as well as a discharge unit 1 of an apparatus for manufacturing a slide fastener equipped with a separable end stop. The discharge unit 1 includes a feed roller 2 driven into rotation at any suitable time, and a press roller 3 which is freely rotatable, and is arranged so that the press roller 3 may be elevated when required, as shown in FIG. 3, to clamp a slide fastener 4 between itself and the feed roller 2, the latter then being rotated to advance the slide fastener and discharge it from the fastener manufacturing apparatus. The fastener manufacturing apparatus includes a transfer unit in the form of grippers 5, shown in FIG. 2. Each of the grippers 5 travels along a guide rod 7 while gripping the leading end of a tape 6 constituting the slide fastener, during which time a pin 8, box pin 9 and box 11 are attached by various units, not shown. The tape is cut to a prescribed length, and the slide fastener having the separable end stop attached thereto is completed, by the time the grippers 5 arrive at the position shown in FIG. 2.

The inspection apparatus S is disposed downstream of the discharge unit 1 and has vertically movable upper and lower molds 16, 17 which are secured to the cylinder 19 and piston rod 21, respectively, of an air cylinder unit 18. Thus, varying the overall length of the air cylinder unit 18 by suitable control of air pressure moves the upper and lower molds 16, 17 toward or away from each other. The upper mold 16 is urged downwardly by a compression spring 23 inserted between the upper mold and the frame 22 of the inspection apparatus, and the lower mold 17 is urged upwardly by a spring 24 inserted between the lower mold and the frame 22, the lower spring 24 being designed to apply a stronger force than the spring 23. Accordingly, when the air cylinder unit 18 is reduced in length starting from the condition shown in FIG. 1, the ascent of the lower mold 17 precedes the descent of the upper mold 16. A stopper, not shown, is provided to stop the upward motion of the lower mold 17, the distal end of which is provided with a recess 25 for receiving the box 11. The stopper is arranged to halt the lower mold 17 at a position where the box 11 will fit into the recess 25. This position is shown in FIG. 3. The upper mold 16 is similarly provided with a box receiving recess 26 corresponding to the recess 25. Therefore, as shown in FIG. 3, reducing the length of the air cylinder unit 18 causes the box 11 to be received in and accommodated by the recesses 25, 26 so as to be held between the upper and lower molds 16, 17.

The lower mold 17 is provided with a plunger 27 biased by a spring so as to project into the recess 25. When the upper and lower molds 16, 17 are closed on each other, the plunger 27 will be pressed downwardly against the force of the spring by the box 11 if the box is present in the recess 25. As shown in FIG. 3, this will cause the lower end of the plunger to block the light path between a pair of photosensors 28, one of which is a light-emitting element and the other a light-receiving element, in response to which the light-receiving element issues a signal indicating the presence of the box 11. When upper and lower molds 16, 17 separate from each other, the plunger 27 acts to discharge the box 11 from the recess 25 owing to the force applied by the spring. The upper and lower molds 16, 17 are each provided with a photosensor 29, one of which is a light-emitting element and the other a light-receiving element arranged so that the light path between them will be blocked by the pin 8 and box pin 9. The arrangement is such that a signal indicative of an abnormality will be produced by the light-receiving element if the quantity of light being received from the light-emitting element exceeds a predetermined value. The photosensors 29 therefore are capable of confirming that the pins 8, 9 are present, and that the pins are parallel and closely adjacent to each other without any large gaps between them, by sensing that the quantity of light passing between the pins is less than the predetermined value.

Figure 5:
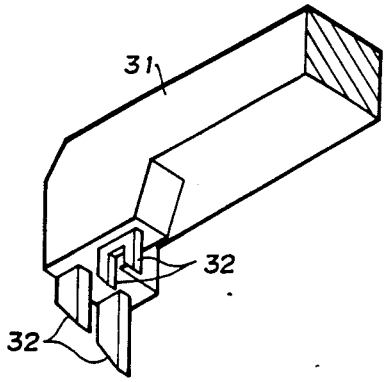
FIG. 5 is a perspective view showing the details of inspecting projections provided on a pivoting lever for inspecting notches formed in a pin, box pin and box.
Figure 5:
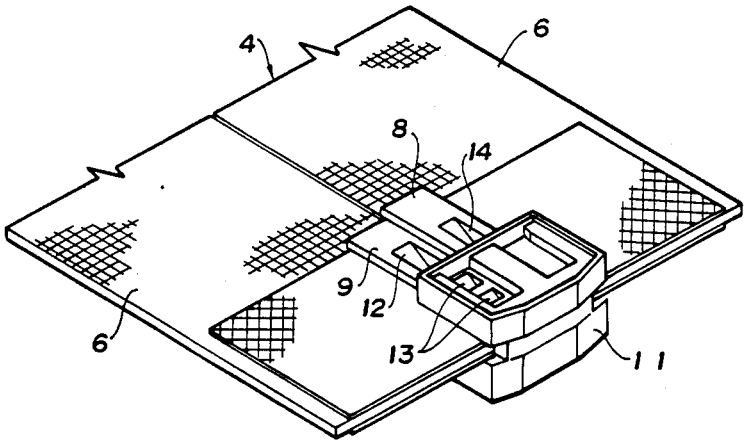

The upper mold 16 is provided with an inspecting member which is capable of being displaced relative to the upper mold. In the illustrated embodiment, the inspecting member comprises a pivoting lever 31, the distal end whereof has inspecting projections 32 positioned so as to fit into notches 12, 13, 14 formed in the box pin 9, box 11 and pin 8, respectively, as shown in the detailed view of FIG. 5. The pivoting lever 31 is biased in the counterclockwise direction about a pin 34 by a spring 33, but is pivoted in the clockwise direction about the pin 34 due to engagement between the inspecting projections 32 and the bottoms of the notches 12, 13, 14 when the upper and lower molds 16, 17 are closed. The amount by which the lever 31 pivots is sensed by a displacement sensor 35. In the illustrated embodiment, the displacement sensor 35 comprises an indicator incorporating a dial gauge-type meter for indicating the amount of displacement. If the amount by which the pivoting lever 31 pivots is greater than a predetermined value, then this indicates that at least one of the notches 12, 13, 14 has a depth shallower than that prescribed, or has not been formed at all. It should be noted that the amount of pivotal movement made by the lever 31 can be sensed by measuring the amount of rotation made by the pin 34, providing that the pin is arranged to rotate together with the lever 31. Further, while the inspecting member comprises the pivoting lever 31 in the illustrated embodiment, the member can be so provided as to move up and down relative to the upper mold 16.

Figure 4:
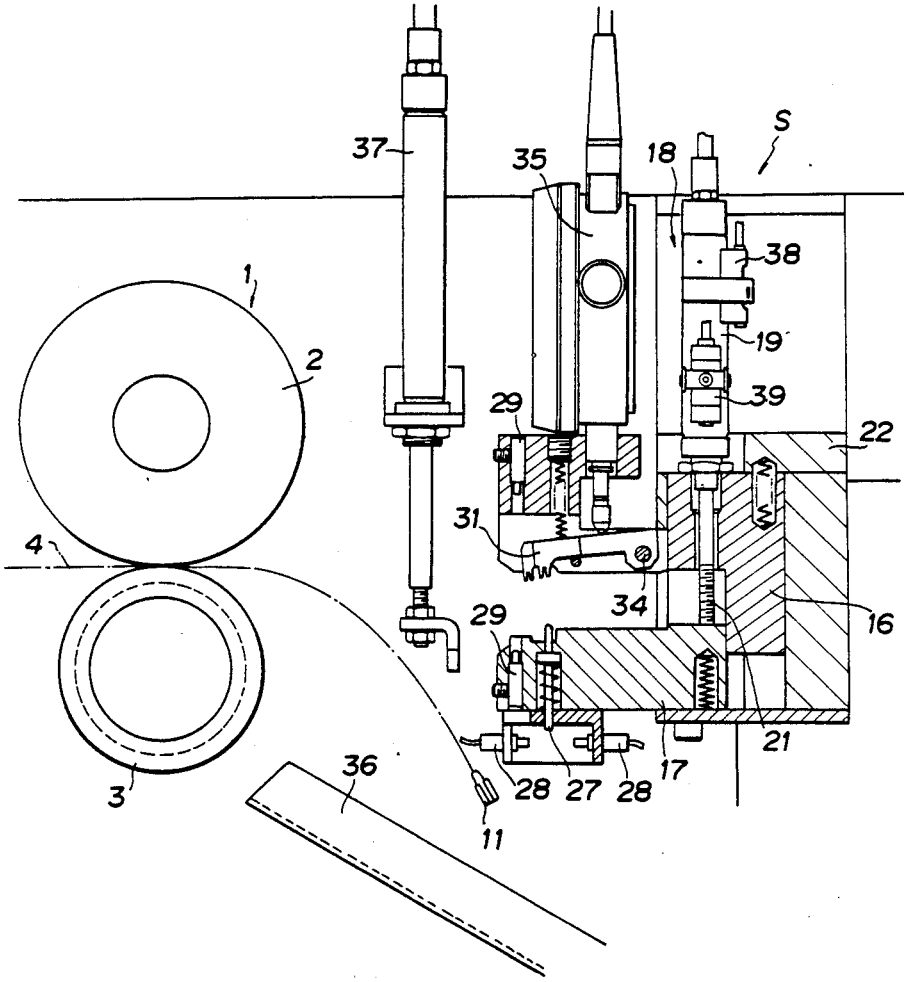
FIG. 4 is a view, which is similar to that of FIG. 3, showing the direction of a slide fastener being changed as a deflecting unit becomes operational after an inspection.

The inspection apparatus also includes a deflecting unit 37 for directing the slide fastener 4 toward a discharge tray 36 after an inspection. The deflecting unit 37 comprises an air cylinder which, when extended as described hereinbelow, urges the leading end portion of the slide fastener 4 toward the tray 36, as shown in FIG. 4.

The overall operation for performing an inspection activity is as follows. The grippers 5 grip the leading end of the slide fastener 4, pass it through the discharge unit 1 and bring it to a point where the box 11 arrives at a position corresponding to the recess 25. When the grippers 5 arrive at this point, the action of a limit switch (not shown) sends a signal to the inspection apparatus, in response to which the air cylinder unit 18 is reduced in length to close the upper and lower molds 16, 17, whereby the molds grasp the box 11. At the same time, the press roller 3 is raised in position to clamp the slide fastener 4 between itself and the feed roller 2. This condition is detected by a limit switch 38, the latter producing a signal in response to which the grippers 5 release the slide fastener 4 and then return to its starting point along the guide rods 7. From this point onward, until the completion of the next slide fastener, the slide fastener manufacturing apparatus operates to attach a separable end stop to the fastener stringer independently of the operation performed by the inspection apparatus. It will be appreciated from the above-described inspection arrangement that the presence of the pin 8, box pin 9 and box 11, the depth of the notches 12, 13, 14, and the space between the pin 8 and box pin 9, are inspected instantaneously the moment the upper mold 16 and lower mold 17 are closed. When the inspection is completed, the air cylinder unit 18 is extended in length to open the upper and lower molds 16, 17. A limit switch 39 produces a signal upon detecting the open state of the molds, in response to which the air cylinder constituting the deflecting unit 37 is extended in length to deflect the leading end of the slide fastener 4 toward the tray 36. Simultaneously with the operation of the deflecting unit 37, or at any time before or after, the feed roller 2 is driven into rotation to feed the slide fastener into the discharge tray 36. The discharge tray 36 is provided with a selecting unit, not shown, which rejects faulty slide fasteners from the system in response to a signal from the inspection apparatus.

It will be apparent from the foregoing arrangement that, according to the invention, the slide fastener 4 is passed through the discharge unit 1, and the inspection apparatus S is provided downstream of the discharge unit, so that the leading end of the slide fastener 4 can be fed to the inspection apparatus S merely be extending the operating stroke of the transfer unit a very short distance. Moreover, since the inspection apparatus S grasps the leading end of the slide fastener 4, the transfer unit can be returned as soon as the slide fastener is so grasped. Such an arrangement has almost no influence upon the conventional process for manufacturing a slide fastener equipped with a separable end stop.

Figure 6:
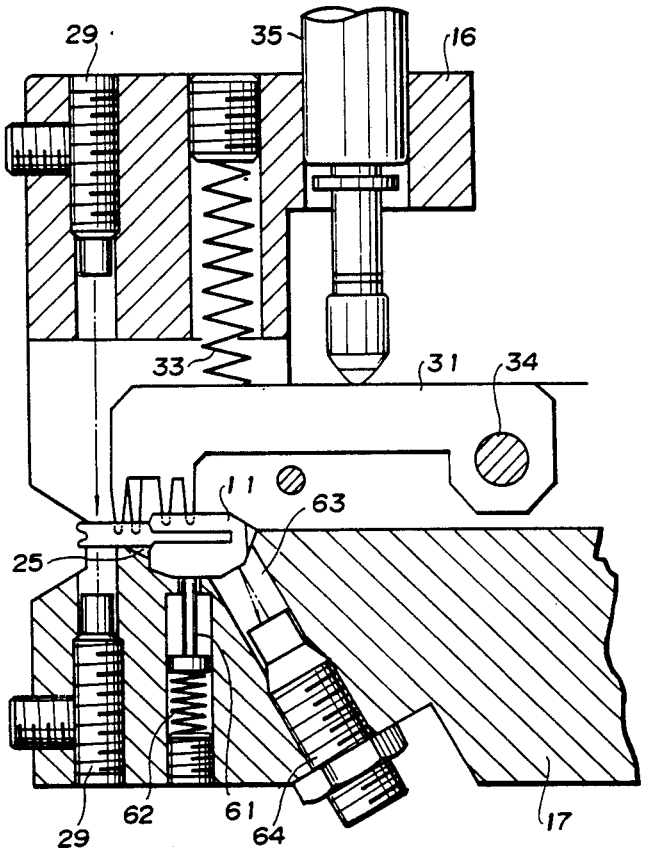
FIG. 6 is a sectional view corresponding to that of FIG. 1 and illustrating another embodiment of an inspection apparatus according to the present invention.

FIG. 6 illustrates another embodiment of the present invention which, with the exception of the points described hereinbelow, has a construction identical with that of the embodiment shown in FIG. 1. Portions similar to those of the foregoing arrangement are designated by like reference characters.

In FIG. 6, a plunger 61 is urged upwardly by a spring 62. When the upper and lower molds 16, 17 are opened, therefore, the plunger 61 ejects the box 11 from the recess 25. In this embodiment, the presence of the box 11 in the recess 25 is not detected by the plunger 61 but by a photosensor 64 attached in an aperture 63 provided in the lower mold 17. The photosensor 64 includes a light-emitting portion for projecting a light beam substantially perpendicular to one surface of the box 11, and a light-receiving portion for receiving light reflected from this surface. Thus, reflected light received by the light-receiving portion is an indication that the box 11 is present in the recess 25.

Thus, in accordance with the inspection apparatus of the present invention as described and illustrated hereinabove, the depth of notches for caulking, provided in a pin, pin box and box, are verified by means of inspecting projections at the same time that the box is grasped by the upper and lower molds. This makes possible an inspection operation which is both fast and accurate.

I claim:

1. An inspecting apparatus used in a slide fastener manufacturing apparatus which attaches separable end stops each consisting of a pin, a box pin and a box to fastener stringers while the stringers are transported to complete slide fasteners and has a discharge unit for discharging the completed slide fasteners, said inspecting apparatus being placed downstream of said discharge unit and in combination with a completed slide fastener in order to inspect the attached state of the separable end stops of the slide fasteners and comprising an upper mold and a lower mold, means for opening and closing said upper and lower molds, each mold having a retaining portion integral therewith for grasping a box of a separable end stop when said molds are closed, an inspecting member connected to one of said molds, said inspecting member being structured so that it is displaceable relative to said one of molds and having inspecting projections which fit into caulking notches formed in the pin, box pin and box of the separable stop, means for biasing said inspecting member in a direction for fitting said inspecting projections into said notches, and sensing means to sense the depth of said notches based on displacement of said inspecting member when said upper and lower molds are closed.

2. An inspecting apparatus according to claim 1, wherein said inspecting member comprises a lever having one end thereof pivotably connected to said upper mold, said inspecting projections being formed on the other end of said lever, and said sensing means comprises a meter for measuring the amount of oscillation of said lever.

3. An inspecting apparatus according to claims 1 or 2, wherein said lower mold has a plunger mounted for movement relative to the lower mold and a spring for biasing the plunger so that the plunger projects into said retaining portion of the lower mold, the inspecting apparatus further including means for detecting the presence of the box in said retaining portion by the displacement of said plunger.

* * * * *